US006003189A

United States Patent [19]

Falleiros

[11] Patent Number: 6,003,189

[45] Date of Patent: Dec. 21, 1999

[54] TOOTHBRUSH

[76] Inventor: Alexandre Petrocini Falleiros, Praca Romao Gomes, 8, apto. 33, Sao Jose dos Compos-SP, Brazil

[21] Appl. No.: 09/209,212

[22] Filed: Dec. 11, 1998

Related U.S. Application Data

[63] Continuation of application No. 09/026,832, Feb. 20, 1998, abandoned, which is a continuation of application No. 08/832,734, Apr. 4, 1997, abandoned, which is a continuation of application No. 08/591,808, Jan. 25, 1996, abandoned.

[30] Foreign Application Priority Data

Feb. 1, 1995 [BR] Brazil ..... 9500531

[51] Int. Cl.[6] ..... A46B 9/04

[52] U.S. Cl. ..... 15/167.1; 15/172

[58] Field of Search ..... 15/143.1, 144.1, 15/167.1, 172

[56] References Cited

U.S. PATENT DOCUMENTS

| | | | |
|---|---|---|---|
| 4,520,526 | 6/1985 | Peters | 15/172 |
| 5,054,154 | 10/1991 | Schiffer et al. | 15/172 |
| 5,105,499 | 4/1992 | Dirksing | 15/143.1 |
| 5,146,645 | 9/1992 | Dirksing | 15/143.1 |

FOREIGN PATENT DOCUMENTS

| | | | |
|---|---|---|---|
| WO 88/06417 | 2/1988 | WIPO | 15/143.1 |
| WO 89/10076 | 11/1989 | WIPO | 15/167.1 |

*Primary Examiner*—Terrence R. Till
*Attorney, Agent, or Firm*—Lawrence D. Schuler

[57] ABSTRACT

A toothbrush comprising, generally in a sole piece, an elongated handle (10); one head (20) carrying, on the front side, a set of bristles (40); and a flexible neck (30) joining the handle (10) and the head (20) and comprising a pair of front (31) and rear (32) spaced longitudinal beams (33) and having their opposite extreme ends respectively united to the head (20) and the handle (10) through localized bending regions (34) which allow the beams to operate as parallelogram articulation arms when the head (20) is displaced in transversal direction in relation to the handle (10) and in a plane containing the longitudinal axis of the handle (10) and being parallel to the longitudinal axes of the bristles (40), from an inoperative rest position to operative positions. The brush is provided with a shock absorbing means (50), acting against the neck (30) and preferably by means of an elastic element fitted to the aperture (33) between the beams, in such a manner as to be elastically deformed when the head (20) is displaced from its inoperative position to any of its operative positions.

14 Claims, 3 Drawing Sheets

10
20
22
30
31
32
33
33a
34
40
50

TOOTHBRUSH

This application is a continuation of U.S. application Ser. No. 09/026,832 filed Feb. 20, 1998, now abandoned, which is a continuation of U.S. application Ser. No. 08/832,734 filed Apr. 4, 1997, now abandoned, which is a continuation of U.S. application Ser. No. 08/591,808 filed Jan. 25, 1996, now abandoned.

FIELD OF INVENTION

This invention refers to a toothbrush that is resiliently flexible between its head and handle portions, so as to apply suitable bristle pressure against the teeth and gums, in response to the force applied by the user of the brush.

BACKGROUND OF THE INVENTION

Within the aspects connected to good brushing, as studied by dentists and toothbrush manufacturers, one of the most important ones has been the optimization of the bristle pressure applied to the teeth and gums, so as to provide maximum bucal hygiene, without loss or lesion to the gums or to the dentine or enamel of the teeth.

Just as there are more easily accessible regions in the dental arcades, where brushing is more comfortable and the force applied to the brush can be more easily controlled, there are other regions of more difficult access, frequently requiring the user to change the position of his or her hand, and where it is found that the user loses control over the force applied to the brush.

The result is that bucal hygienic using conventional toothbrushes leads to uneven brushing, causing gum and bucal deterioration in some regions due both to deficient cleaning and excessive abrasion by brushing.

In order to overcome the foregoing problem, it has become clear that a toothbrush should be provided with some means to absorb part of the force applied by the user to the toothbrush.

In addition to variations in the flexibility of the bristles, the adopted solutions generally consist of applying a resiliently flexible means to a region of the brush head or, more frequently, to an intermediate portion between the brush handle and head.

Among the solutions directed to the head construction is one described in PCT/EP/92/00645 (WO92/17092) which describes a toothbrush provided with a flexible head, resiliently connected to a prolonged portion of the handle, the latter surrounding the brush head or the head partially surrounding the prolonged portion, the head being cable of making an oscillatory movement in relation to the prolonged portion of the handle. In a second solution, described in U.S. Pat. No. 4,633,542, a soft elastomer is applied under the bristles. In a third solution, described in U.S. Pat. No. 2,631,320, the brush head is cut between each transverse row of bristles, the different portions thus formed being spacedly interconnected by a longitudinal laminate spring element, fixed at one end to the brush handle, in such a way as to become vertically bendable.

Such solutions, among others applied to the toothbrush head, have two limitations in common which, by themselves, tend to render such brushes commercially unfeasible: high cost, due to their complex construction, and the impossibility of adequate cleaning of the brush after use, whereby the head cumulatively retains food residues and thus propitiates the proliferation of fungus, bacteria and other microorganisms.

Consequently, since they avoid the above serious limitations, many resiliently flexible brushes incorporate their resilient deflecting means in an intermediate portion between the brush handle and head.

One manner which has proved to be efficient to obtain a resiliently flexible means for controlled articulation of the head of a toothbrush with its handle, at an accessible cost for the consumer, was by weakening the intermediate portion between the handle and the head, that is, the toothbrush neck, by removing the material comprising the handle, such as described in patent DE 36,40898.

Within such principle of construction, many other more complex solutions have been presented: in a first solution, described in PCT/EP93/00299 (WO93/15627), the neck is provided with many annular grooves, in such a manner as to form a single central beam with a reduced diameter and incorporating a plurality of flanges with a profile substantially the same as that of the handle. In this construction, the degree of neck flexibility is determined by the diameter and the extension of the central beam that defines the neck and the angular limit of head displacement in relation to the handle is determined by the abutment of flanges against each other.

In a second construction, described in U.S. Pat. No. 4,520,526, the brush is provided with a resiliently flexible neck obtained by removal of the material from the front and back faces of the handle, to form corresponding cavities so as to produce an area of reduced cross section. In a third solution, also described in U.S. Pat. No. 4,520,526 as well as PCT/US92/00681 (WO92/15225), material is removed from the intermediate portion of the brush neck, so as to define a longitudinally extended transverse through aperture that is limited by front and rear longitudinal beams, the greater or lesser thickness of such beams determining a greater or lesser resistance to bending of the brush head in relation to the handle, in an axial plane which is parallel to the axis of the bristles.

Other variations of the construction described in the last example have also been developed, such as the one described in U.S. Pat. No. 5,146,645, in which a reduction of the thickness is provided in a median region of the front beam, defining a point of lower mechanical or of localized bending so as to allow such median region of the beam to bend, as a result of a force applied by the user to the brush, until it abuts the front face of the rear beam, indicating to the user that he/she has exceeded the acceptable limit of brushing force.

In spite of solving, to a greater or lesser degree, the basic problems related to complexity and hygienics as previously mentioned, the foregoing constructions suffer from two new drawbacks, namely: upon bending the brush, and considering that the user always tends to keep the brush handle in the same position when brushing a given tooth, the angle of contact of the bristles in relation to the tooth is altered by a value substantially equal to the angle formed between the bent brush head and the handle, resulting in deficient brushing and uneven wear of the bristles. In addition, as these toothbrushes are generally molded as a single piece made of thermoplastic material, constant localized bending of one of the neck beams causes fatigue and weakening of the material at the point of the bending, reducing its elastic memory, which causes a cumulative deformation of the toothbrush, which generally becomes useless due to the excessive deformation of its neck when its bristles are still in good condition.

Yet, within the construction which provides for a flexible neck, another solution is suggested, as described in U.S. Pat.

No. 5,315,732, according to which the neck is defined by a pair of front and rear flexible laminate beams, such beams having their bending extension controlled by a piston which slides between the beams and incorporated to an end of a rigid rod, the other end of which is manually, but relatively tightly slidable, in an axial groove in the brush body. The piston positioning adjusts the length of the beams that is a available for bending and, consequently, the degree to which the neck is flexible. It happens that, apart from involving a complex construction, this solution requires from the user a certain practice and some care in order to obtain an adjustment that meets his/her brush use characteristics. This construction has the positive aspect of adjusting the degree of neck flexibility which however, is annulled by the impossibility of keeping the same dihedral angle between the handle and the head upon moving the latter and by the fact that this kind of construction tends to result in the accumulation of residues.

It is, therefore, the overall object of this invention to provide a toothbrush which is resiliently flexible between its head and handle, of low cost, high brushing performance, of long life, and easy to clean.

It is a specific object of this invention to provide a toothbrush, as above described, which may keep the working plane of the bristles at a substantially constant angle with respect to the longitudinal axis of the handle, even under maximum contact pressure of the bristles.

It is also an object of this invention to provide a toothbrush, as above described, the neck of which has a substantially constant elastic memory throughout the useful life of its bristles.

It is further an object of this invention to provide a toothbrush, as described above, which allows the manufacturer or the user to vary the degree of flexibility of the brush neck, without changing the construction of its body, head or neck.

These and other objectives and advantages of the present invention are obtained by providing a toothbrush comprising: an elongated handle; a head with a front face, in which a set of bristles is affixed; and a flexible neck, interlinking the handle and the head. In accordance with the invention, the neck is defined by a front longitudinal beam and a rear longitudinal beam that are spaced from each other and have their opposite ends respectively connected to the head and handle though localized bending regions, whereby the head may be slid, both transversally and relative to the handle, in a plane containing the longitudinal axis of the handle and which is parallel to the bristles axes, from an inoperative rest position to operative positions, by maintaining the same dihedral angle between the longitudinal axes of the handle and head, such brush being also provided with an elastic shock absorbing means acting in the neck, in such a manner as to be elastically deformed when the head is displaced from its inoperative position to any of its operative positions, such elastic shock absorbing means constantly biasing the head towards its inoperative position. In practical terms, the toothbrush according to the invention combines the known advantages of the conventional brush and of a resiliently flexible brush, that is, low cost, constant positioning of the working plane of the bristles against gums and teeth and suitable adjustment of brushing pressure.

In addition, besides not presenting any of the usual limitations of the known toothbrushes, the proposed brush also presents two other entirely new aspects, by way of a manner for maintaining the elastic memory which, when applied to the brush neck, means that its elastic memory is extended to the whole useful life of the bristles, and the adjustment of the degree of neck flexibility, without changing the basic features of the brush, by using different shock absorbing means, selected in accordance with the user's particular needs.

BRIEF DESCRIPTION OF DRAWINGS

The invention will now be described with reference to the annexed drawings, in which.

DESCRIPTION OF THE PREFEFFED EMBODIMENTS

Figures 1, 2:
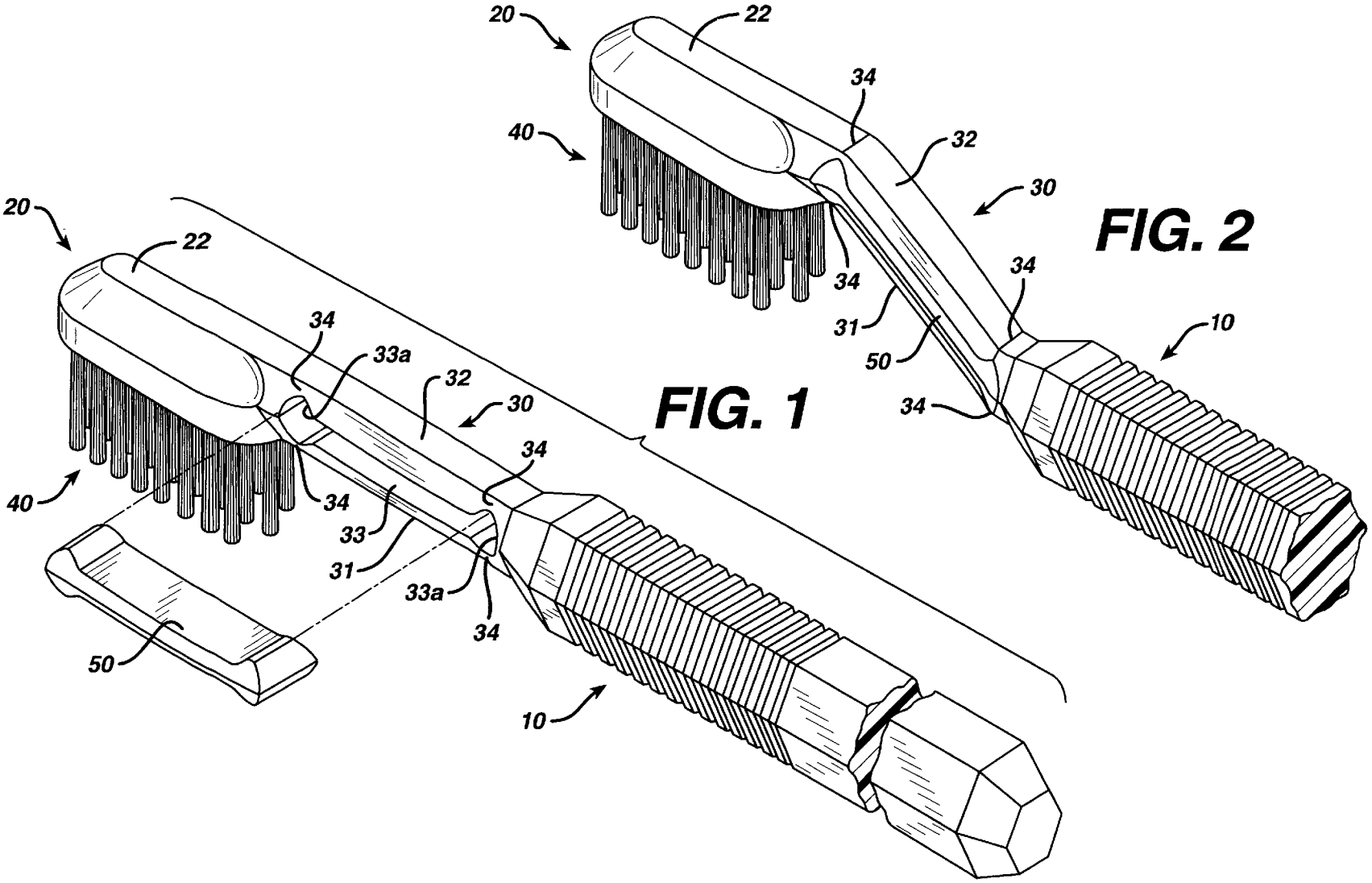
FIG. 1 shows a partially exploded rear and side perspective view of the brush in question with the head in the rest position.
FIG. 2 shows a view similar to that of FIG. 1, with the elastic memory means in position and the head displaced rearwardly.
Figure 3:
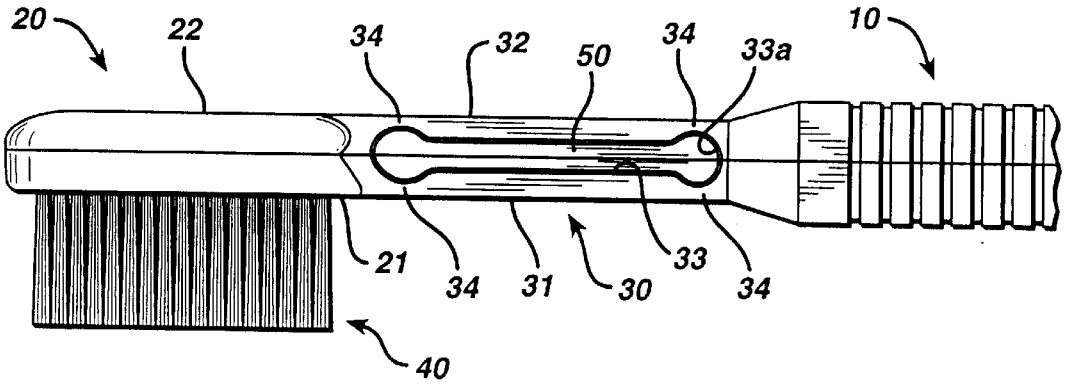
FIGS. 3 and 4 are side views of the toothbrush shown in FIGS. 1 and 2, in the rest position and in the rearwardly displaced position, respectively.
Figure 4:
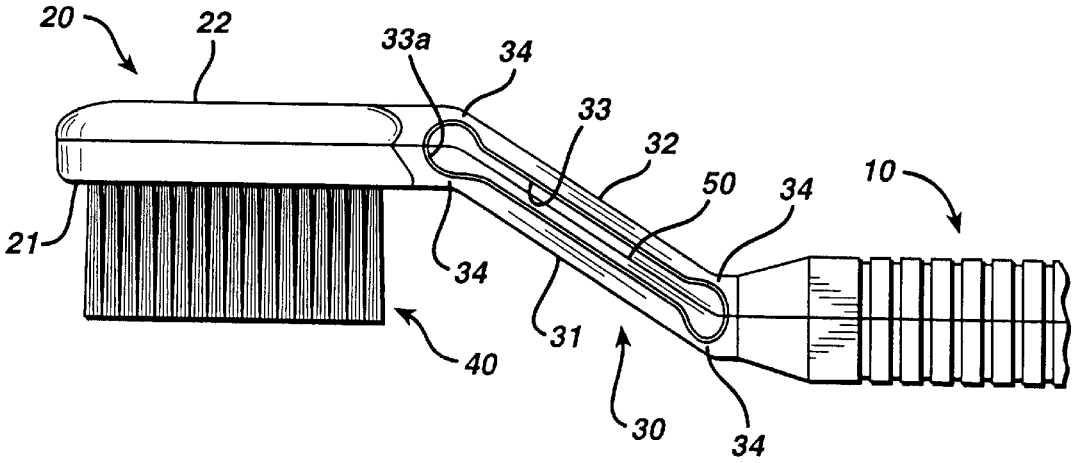

In accordance with the above described figures, the proposed toothbrush, preferably made of thermoplastic material, comprises an elongated handle 10 and a head 20 presenting a front face 21, to which a set of bristles 40 is affixed in any known manner.

In the shown embodiment, the brush head 20 is longitudinally, flexibly and resiliently united as a single piece to the handle 10 by means of a neck 30, the latter being defined by a front longitudinal beam 31 and a rear longitudinal beam 32 that are spaced from each other, the front face of the former and the rear face of the latter being generally in the same plane, respectively, as the front and rear faces of the adjacent portions of the toothbrush head 20 and handle 10.

The spacing between the front 31 and rear 32 longitudinal beams defines a transverse through aperture 33 in the neck 30, longitudinally extended with respect to the latter.

As shown in FIGS. 1 to 4, in each longitudinal end, the aperture 33 has the shape of an enlargement defined by a substantially cylindrical through hole 33*a* in the neck 30, having a diameter that is larger than the height of said aperture 33, in such a way as to reduce the thickness of the end portions of the front 31 and rear 32 longitudinal beams. The reduced thickness end portions of the beams define localized bending regions 34 of the neck 30.

The localized bending regions 34 of the neck 30 are located in transversally opposite points of each transversal end hole 33*a*, relative to the common longitudinal axis of the head, neck and handle when the head is in the inoperative position. In function of such disposition, the toothbrush becomes deformed during brushing at specific bending regions that define a kind of parallelogram articulation with the two beams 31, 32 of the neck 30, that is, the brush head 20 is transversally displaced relative to the handle, generally backwardly, in a plane containing the axis of the handle and is parallel to the axes of the bristles 40, without occurrence of any change in the angle formed between the axis of the head 20 and of the handle 10.

In the shown configuration, this angle is 180 degrees. In practice, this means that, regardless of the force applied by the user to the brush, the free end of the bristles 40 will be constantly in contact with the surface to be brushed.

Depending on the material used to form the brush as a single piece, the elastic shock absorbing means may be defined by the localized bending regions 34 themselves, such plastic deformation acting to absorb excessive force applied by the user to the brush during use and also as an elastic memory means to cause the return of the head 20 to the inoperative position after the force to it has stopped.

However, considering that the foregoing solution may lead to an earlier fatigue of the localized bending regions 34 and may also be insufficient to produce the desired shock absorbing and return effects, it is possible and even advisable that the shock absorbing means be also or only defined by at least one elastic means 50, mounted on the brush in such a way as to be elastically deformed upon the displacement of the head 20 to any of its operative positions.

In the shown configuration, the elastic element 50 is a one-piece part fitted relatively tightly into the space defined by the aperture 33 and by its end enlargement 33*a*. In this condition, upon the displacement of the head 20 to its operative positions, the elastic element becomes elastically deformed, both due to a certain bending in the junction region of its enlarged end edges with its median section between beams, and due to compression of this same median section because of the approach of the two beams. Upon being relieved from the axial forces over the bristles, the elastic element 50 operates to effect the returning to its original format, bringing the head 20 to its inoperative rest position, in which beams 31 and 32 generally remain unbent at their end portions where they are united to the head and the handle. The elastic element 50 is transversally dimensioned in relation to the longitudinal axis of the brush in order to be inscribed in the contour of the cross section of the neck 30 and preferably with its side edges coinciding with the referred contour, in such a manner as to prevent formation of saliences or recesses in this portion of the brush.

Figure 5:
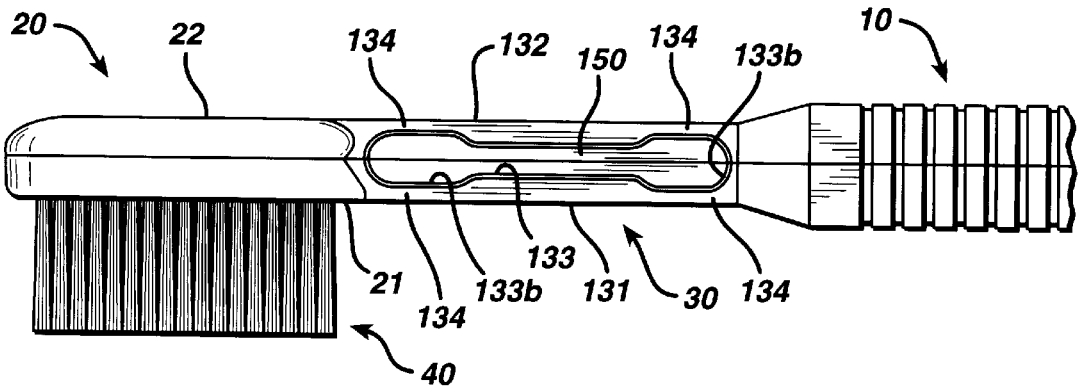
FIGS. 5 and 6 are similar views to those of FIGS. 3 and 4, but present an alternative construction for the localized bending regions of the neck.
Figure 6:
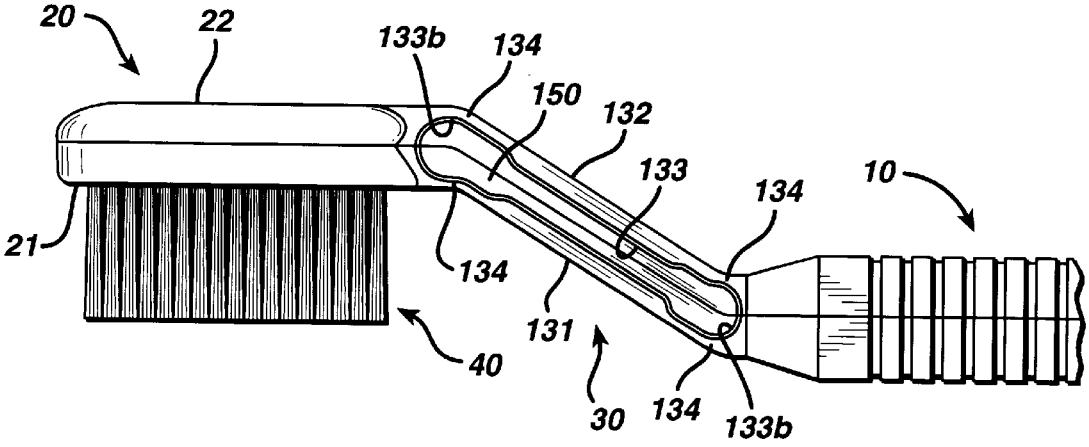

Depending on the features of the brush material, it may happen that the excessive concentration of yield stresses in the brush neck 30, just along a restricted transversal line that defines each bending zone 34, could lead to an earlier weakening of such regions, evidenced by marked changes in the brush material in this region. In order to prevent an eventual earlier prejudice to the useful life of the toothbrush, the dimensioning of the bending regions 134, as shown in FIGS. 5 and 6, may be changed.

In this case, the end enlargements of the aperture 133 may take the shape of oblong transverse holes 133*b* in the neck 30, such oblong holes causing the reduced thickness end portions of the front 131 and rear 132 beams to have a certain longitudinal extension. With this construction change, the yield stresses are distributed along the localized bending regions 134 of longer extension, allowing the head movement to occur by bending in a longer radius of the end portions of front 131 and rear 132 beams. Less deformation results therefrom in the ends of the beams along said bending regions 134, reducing, in a greater or lesser degree, the problem of premature fatigue of the material in these regions. As shown, the width of the cross section of the oblong holes 133*b* is larger than the aperture 133 height, in order to cause the desired reduction of thickness in the ends of the beams.

Evidently, in this second configuration, the elastic element 150 adopts the new shape of the aperture 133 of the neck 130, its construction material being selected according to the criteria already described, and acting in the same manner.

In another configuration, not herein shown, the localized bending regions may be applied to the outside faces of the front and rear beams of the brush neck, providing the same parallelogramic movement of the front and rear beams.

It must also be observed that using a shock absorbing means in the form of an elastic element 50 that is easily replaceable by the manufacturer or by the user, allows changes in the flexibility features of the head 20 through different shock absorbing elasticity properties, such properties, when combined with different flexibility standards of the bristles 40, lead to a great variety of brush standards using a single basic structure defined by handle, neck and head. Each user may select and change the flexibility properties of his/her brush in accordance with a standards table which can be easily prepared by the manufacturer.

I claim:

1. A toothbrush comprising: an elongated handle having a longitudinal axis; a head having a longitudinal axis and having a front side from which a set of bristles is projected; each bristle in the set of bristles having a longitudinal axis; and a flexible neck joining the handle to the head, said neck being defined by a front longitudinal beam having a first end and a second end, said first end opposite said second end, and a rear longitudinal beam having a first end and a second end, said first end opposite said second end, said front and rear beams having their opposite ends respectively connected to the head and to the handle through localized bending regions;

wherein the head may be displaced, both transversely and relative to the handle, in a plane which contains the longitudinal axis of the handle and which is parallel to the longitudinal axes of the bristles, from am inoperative rest position to operative positions, while maintaining the same angle between the axes of the handle and of the head.

2. The toothbrush of claim 1 wherein the axis of the handle is generally parallel to the axis of the head.

3. The toothbrush of claim 2 wherein axis of the head coincides, in the inoperative rest position, with the axis of the handle.

4. A toothbrush comprising: an elongated handle having a longitudinal axis; a head having a longitudinal axis and having a front side from which a set of bristles is projected; each bristle in the set of bristles having a longitudinal axis, and a flexible neck joining the handle to the head, said neck being defined by a front longitudinal beam having a first end and a second end, said first end opposite said second end, and a rear longitudinal beam having a first end and a second end, said first end opposite said second end, said front and rear beams having their opposite ends respectively connected to the head and to the handle through localized bending regions; and an elastic shock absorbing means disposed in the neck in such a manner as to be elastically deformed when the head is displaced from its inoperative rest position to any of its operative positions, said elastic shock absorbing means constantly biasing the head to the inoperative position.

5. The toothbrush of claim 4 wherein the elastic shock absorbing means is at least partially defined by the localized bending regions of the front and rear beams.

6. The toothbrush of claim 4 wherein the shock absorbing means includes an elastic element mounted in an aperture which is formed by the front and rear beams in such a way as to be elastically compressed by the rear beam upon the displacement of the head to any of its operative positions.

7. The toothbrush of claim 6 wherein the elastic element is removably fitted in the aperture such that substantially the entire aperture is occupied by the elastic element.

8. The toothbrush of claim 7 wherein the front and rear beams are formed integrally with the handle and the head.

9. The toothbrush of claim 8 wherein said localized bending regions are defined by respective reduced thickness portions of the front and rear beams.

10. The toothbrush of claim 9 wherein the reduced thickness portions of the front and rear beams are obtained by respective end enlargements of the aperture between the beams, each enlargement defining the reductions of thickness of the adjacent ends of the front and rear beams.

11. The toothbrush of claim 10 wherein the elastic element has opposite end portions that are tightly fitted into the respective end enlargements of the aperture between the beams.

12. The toothbrush of claim 11 wherein the elastic element is shaped in accordance with the profile of the aperture.

13. The toothbrush of claim 10 wherein each enlargement comprises a transverse through hole in the neck, said hole being substantially cylindrical in shape with a diameter which is larger than the height of said aperture.

14. The toothbrush of claim 10 wherein each enlargement comprises a transverse through hole in the neck, said hole having a cross section which is substantially oblong in shape and which has a width which is larger than the height of said aperture.

* * * * *